US007980069B2

(12) United States Patent
Arellano et al.

(10) Patent No.: US 7,980,069 B2
(45) Date of Patent: Jul. 19, 2011

(54) BURNER ASSEMBLY FOR PARTICULATE TRAP REGENERATION

(75) Inventors: Leonel Arellano, Poway, CA (US); Vu Phi, San Diego, CA (US); Anthony Fahme, Chula Vista, CA (US); Alan Kubasco, San Diego, CA (US); Kenneth Smith, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 119 days.

(21) Appl. No.: 12/415,179

(22) Filed: Mar. 31, 2009

(65) Prior Publication Data

US 2009/0277164 A1 Nov. 12, 2009

Related U.S. Application Data

(63) Continuation of application No. 11/094,526, filed on Mar. 31, 2005, now abandoned.

(51) Int. Cl.
*F01N 3/00* (2006.01)

(52) U.S. Cl. ..... 60/297; 60/274; 60/286; 60/295; 60/317; 60/324

(58) Field of Classification Search ..... 60/274, 60/286, 295, 297, 303, 311, 317, 320, 324
See application file for complete search history.

(56) References Cited

U.S. PATENT DOCUMENTS

| | | | |
|---|---|---|---|
| 4,167,852 | A | 9/1979 | Ludecke |
| 4,494,375 | A | 1/1985 | Rao et al. |
| 4,520,624 | A | 6/1985 | Kiyota et al. |
| 4,538,413 | A | 9/1985 | Shinzawa et al. |
| 4,571,938 | A | 2/1986 | Sakurai |
| 4,651,524 | A | 3/1987 | Brighton |
| 4,730,455 | A | 3/1988 | Pischinger et al. |
| 4,813,233 | A | 3/1989 | Vergeer et al. |
| 4,840,028 | A | 6/1989 | Kusuda et al. |
| 4,951,464 | A | 8/1990 | Eickhoff et al. |
| 4,961,314 | A | 10/1990 | Howe et al. |
| 4,987,738 | A | 1/1991 | Lopez-Crevillen et al. |
| 5,009,065 | A | 4/1991 | Howe et al. |
| 5,048,287 | A | 9/1991 | Howe et al. |
| 5,063,737 | A | 11/1991 | Lopez-Crevillen et al. |
| 5,105,621 | A | 4/1992 | Simmons et al. |

(Continued)

FOREIGN PATENT DOCUMENTS

| | | |
|---|---|---|
| WO | 2005070175 | 8/2005 |

*Primary Examiner* — Tu M Nguyen
(74) *Attorney, Agent, or Firm* — Finnegan, Henderson, Farabow, Garrett & Dunner LLP; Keith Roberson

(57) ABSTRACT

An exhaust treatment system is provided. The system may include a particulate trap configured to remove one or more types of particulate matter from an exhaust flow, the exhaust flow including at least a portion of a totality of exhaust gases produced by an engine. The system may further include a burner assembly configured to increase a temperature of gases in the exhaust flow at a location upstream from the particulate trap. The burner assembly may include an exhaust inlet oriented in a direction along a first axis and configured to direct the exhaust flow into the burner assembly and an exhaust outlet oriented in a direction along a second axis at an angle relative to the first axis, the exhaust outlet being configured to direct the exhaust flow out of the burner assembly toward the particulate trap.

21 Claims, 3 Drawing Sheets

U.S. PATENT DOCUMENTS 5,140,814 A 8/1992 Kreutmair et al.
5,320,523 A * 6/1994 Stark ..... 431/353
5,339,630 A * 8/1994 Pettit ..... 60/303
5,417,059 A 5/1995 Haertel et al.
5,605,453 A * 2/1997 Kenner et al. ..... 431/262
5,711,149 A 1/1998 Araki
5,826,428 A * 10/1998 Blaschke ..... 60/303
6,370,879 B1 * 4/2002 Stalder et al. ..... 60/725
6,694,727 B1 2/2004 Crawley et al.
6,843,054 B2 1/2005 Taylor, III et al.
7,025,810 B2 4/2006 Crawley et al.
7,198,483 B2 * 4/2007 Bueche et al. ..... 431/12
2004/0200213 A1 10/2004 Igarashi et al.
2005/0000211 A1 1/2005 Fayard

* cited by examiner

BURNER ASSEMBLY FOR PARTICULATE TRAP REGENERATION

This is a continuation of application Ser. No. 11/094,526, filed Mar. 31, 2005 now abandoned, the entire contents of which are hereby incorporated by reference.

TECHNICAL FIELD

The present disclosure is directed to a particulate trap regeneration system and, more particularly, to a particulate trap regeneration system having a burner assembly configured to increase the temperature of exhaust gases directed to the particulate trap.

BACKGROUND

Engines, including diesel engines, gasoline engines, natural gas engines, and other engines known in the art, may exhaust a complex mixture of air pollutants. The air pollutants may be composed of both gaseous and solid material, such as, for example, particulate matter. Particulate matter may include ash and unburned carbon particles called soot.

Due to increased environmental concerns, exhaust emission standards have become more stringent. The amount of particulates and gaseous pollutants emitted from an engine may be regulated depending on the type, size, and/or class of engine. In order to meet these emissions standards, engine manufacturers have pursued improvements in several different engine technologies, such as fuel injection, engine management, and air induction, to name a few. In addition, engine manufacturers have developed devices for treatment of engine exhaust after it leaves the engine.

Engine manufacturers have employed exhaust treatment devices called particulate traps to remove the particulate matter from the exhaust flow of an engine. A particulate trap may include a filter designed to trap particulate matter. The use of the particulate trap for extended periods of time, however, may enable particulate matter to accumulate on the filter, thereby causing the functionality of the filter and/or engine performance to decline.

One method of restoring the performance of a particulate trap may include regeneration. Regeneration of a particulate trap filter system may be accomplished by increasing the temperature of the filter and the trapped particulate matter above the combustion temperature of the particulate matter, thereby burning away the collected particulate matter and regenerating the filter system. This increase in temperature may be effectuated by various means. For example, some systems employ a heating element (e.g., an electric heating element) to directly heat one or more portions of the particulate trap (e.g., the filter material or the external housing). Other systems have been configured to heat the exhaust gases upstream from the particulate trap allowing the flow of the heated gases through the particulate trap to transfer heat to the particulate trap. For example, some systems alter one or more engine operating parameters, such as air/fuel mixture, to produce exhaust gases with an elevated temperature. Running an engine with a "rich" air/fuel mixture can have such an effect on exhaust gas temperature.

Other systems heat the exhaust gases upstream from the particulate trap, with the use of a burner that creates a flame within the exhaust conduit leading to the particulate trap. For example, one such burner system is disclosed by U.S. Pat. No. 4,641,524, issued to Brighton on Mar. 24, 1987 ("the '524 patent"). The '524 patent discloses a burner system configured to increase the temperature of exhaust gases directed to the particulate trap.

While the system of the '524 patent may increase the overall temperature of the particulate trap, the system of the '524 patent does not include an exhaust outlet configured to direct the exhaust flow out of the burner toward the particulate trap, wherein the exhaust outlet is oriented in a different direction than an exhaust inlet. Further, the system of the '524 patent is not configured to impart rotational motion on fresh air introduced to a fuel injector of the burner to promote an even distribution of the burner flame.

The disclosed burner assembly is directed toward overcoming one or more of the problems set forth above.

SUMMARY OF THE INVENTION

In one aspect, the present disclosure is directed toward a burner assembly for an exhaust treatment system. The burner assembly is configured to increase a temperature of gases in the exhaust flow at a location upstream from a particulate trap. The burner assembly may include an exhaust inlet oriented in a direction along a first axis and configured to direct the exhaust flow into the burner assembly and an exhaust outlet oriented in a direction along a second axis, the exhaust outlet being configured to direct the exhaust flow out of the burner assembly toward the particulate trap. In addition, the burner assembly may include a combustion chamber member defining a combustion chamber configured to house a flame. The burner assembly may further include an exhaust flow distribution member configured to substantially evenly distribute exhaust about the combustion chamber member and in a heat exchange relation to the combustion chamber member.

In another aspect, the present disclosure is directed toward an exhaust treatment system. The system includes a particulate trap configured to remove one or more types of particulate matter from the exhaust flow, the exhaust flow including at least a portion of a totality of exhaust gases produced by an engine. The system may further include a burner assembly configured to increase a temperature of the exhaust flow at a location upstream from the particulate trap. The burner assembly may include an exhaust inlet configured to direct the exhaust flow into the burner assembly and an exhaust outlet configured to direct the exhaust flow out of the burner assembly toward the particulate trap. In addition, the burner assembly may include a combustion chamber member defining a combustion chamber configured to house a flame that is fueled by the fuel injector within the combustion chamber. The burner assembly may further include an exhaust flow distribution member positioned about the combustion chamber member and configured to substantially evenly distribute the exhaust flow about the combustion chamber member and in a heat exchange relation to the combustion chamber member.

In another aspect, the present disclosure is directed toward a method of regenerating an exhaust particulate trap. The method may include directing an exhaust flow, produced by an engine, into a burner assembly, the exhaust flow including at least a portion of a totality of exhaust gases produced by an engine, the burner assembly being located upstream from a particulate trap configured to remove one or more types of particulate matter from the exhaust flow. The method may further include directing the exhaust flow through an exhaust flow distribution member and thereby substantially evenly distributing the exhaust flow about a combustion chamber member to remove heat from the combustion chamber member, the heat being created by a flame within the combustion chamber member. In addition, the method may include directing the heated exhaust flow out of the burner assembly and to the particulate trap to thereby increase a temperature of the particulate trap.

DETAILED DESCRIPTION

Reference will now be made in detail to the drawings. Wherever possible, the same reference numbers will be used throughout the drawings to refer to the same or like parts.

Figure 1:
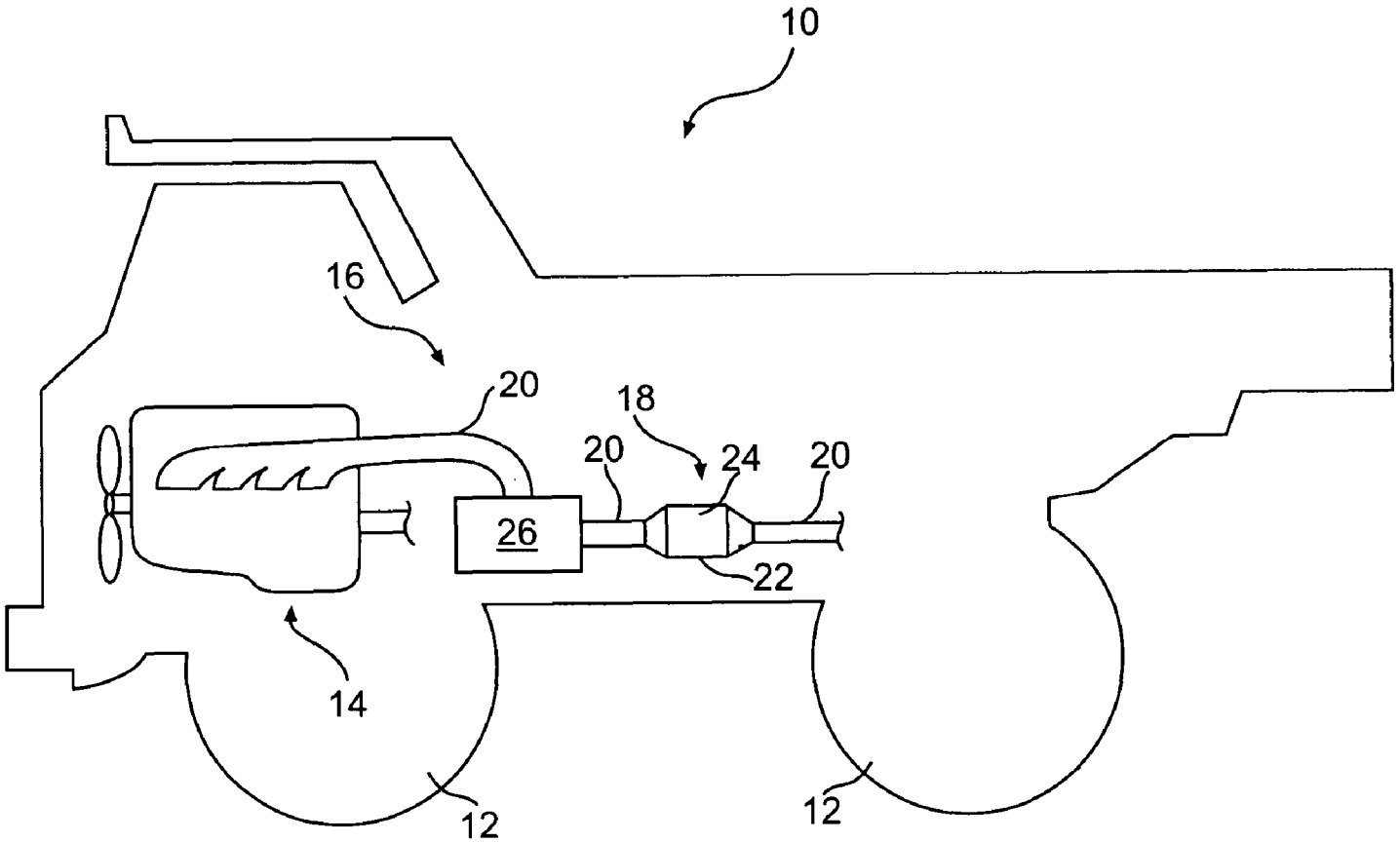
FIG. 1 is a diagrammatic illustration of a work machine according to an exemplary disclosed embodiment.

FIG. 1 illustrates a work machine 10. Work machine 10 may include one or more traction devices 12, an engine 14, and an exhaust treatment system 16.

Although work machine 10 is shown as a truck, work machine 10 could be any type of machine having an exhaust producing engine. Accordingly, traction devices 12 may be any type of traction devices, such as, for example, wheels, as shown in FIG. 1, tracks, belts, or any combinations thereof.

Engine 14 may be any kind of engine that produces an exhaust flow of exhaust gases. For example, engine 14 may be an internal combustion engine, such as a gasoline engine, a diesel engine, a natural gas engine or any other exhaust gas producing engine.

System 16 may include a particulate trap 18 and an exhaust conduit 20 for directing all or a portion of the exhaust gases produced by engine 14 to particulate trap 18. Particulate trap 18 may be configured to remove one or more types of particulate matter from the exhaust gases flowing through exhaust conduit 20. Particulate trap 18 may include an outer housing 22, which may encase a filter material 24 (e.g., a metal mesh) for trapping particulate matter.

System 16 may also include a burner assembly 26 configured to increase the temperature of the exhaust gases flowing through exhaust conduit 20 upstream from particulate trap 18. Burner assembly 26 may be configured to maintain or restore the performance of particulate trap 18 through thermal regeneration. Accumulation of exhaust flow constituents in particulate trap 18 may result in a decline in engine performance and/or possible damage to particulate trap 18 and/or other components of system 16. Burner assembly 26 may be configured to prevent or restore any decline in engine performance and avoid possible damage to particulate trap 18 and/or other components of system 16. For example, burner assembly 26 may be configured to cause at least some of the particulates that may have accumulated in particulate trap 18 to be burned off.

Figure 2:
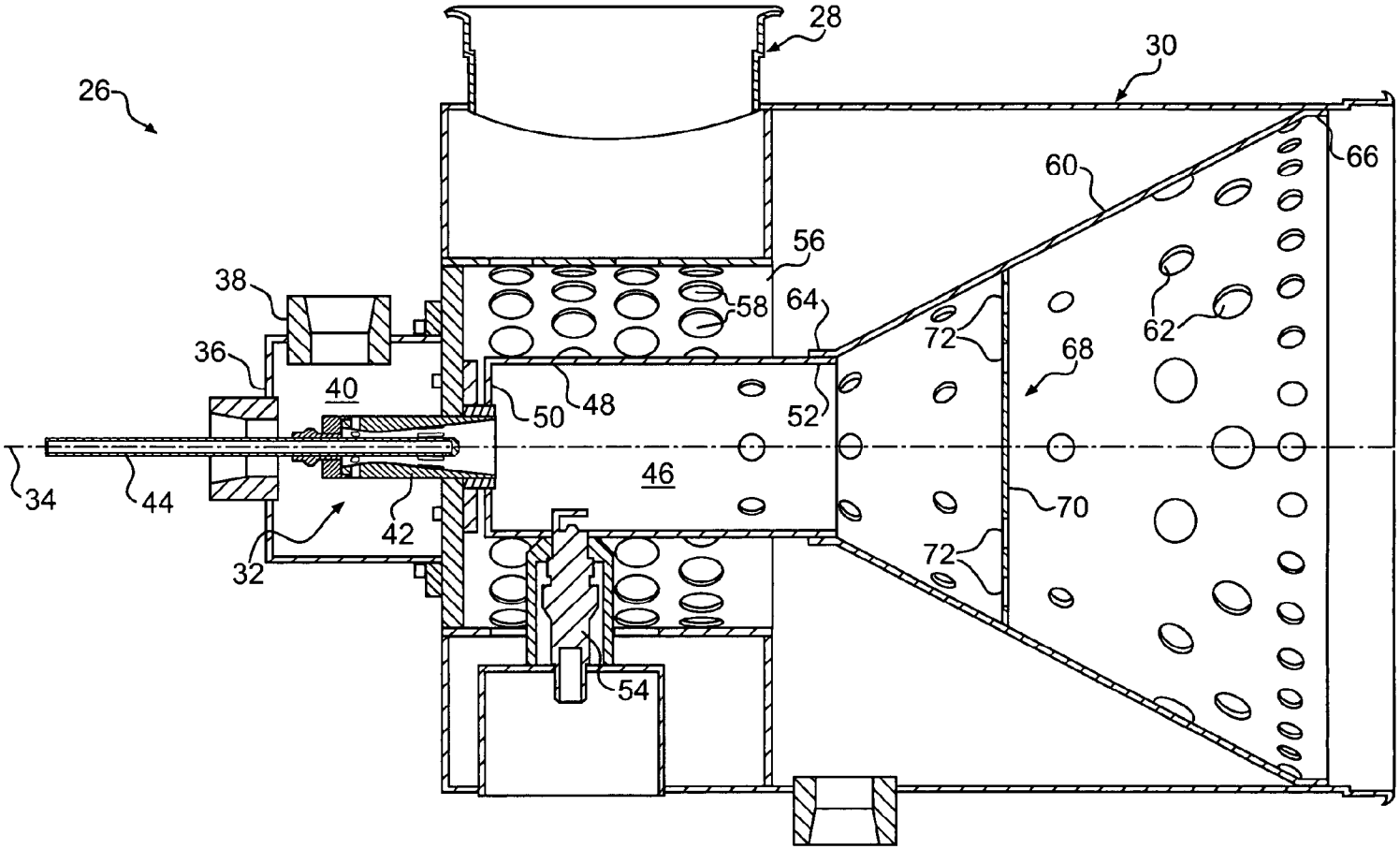
FIG. 2 is a diagrammatic, cross-sectional illustration of a burner assembly according to an exemplary disclosed embodiment.

Referring now to FIG. 2, burner assembly 26 may include an exhaust inlet 28 configured to direct the exhaust flow from engine 14 into burner assembly 26. Burner assembly 26 may also include an exhaust outlet 30 configured to direct the exhaust flow out of burner assembly 26 toward particulate trap 18. Exhaust outlet 30 may be oriented in a direction along an axis at an angle relative to an axis in which exhaust inlet 28 may be oriented. For example, exhaust outlet 30 may be oriented in a direction substantially perpendicular to exhaust inlet 28, as shown in FIG. 2, or at any other angle relative to exhaust inlet 28.

Burner assembly 26 may include a fuel injector 32 having a longitudinal axis 34 in substantial alignment with the direction in which exhaust outlet 30 is oriented. Fuel injector 32 may be configured to deliver fuel and fresh air to burner assembly 26 to fuel a flame. Fuel injector 32 may be housed within an air plenum 36. A fresh air supply for fuel injector 32 may be directed through an air inlet 38 into an air chamber 40 within air plenum 36. This air may then be directed through openings (see FIG. 3) in an outer annular wall 42 about a fuel conduit 44, through which fuel may be directed. Fuel injector 32 is described in greater detail below with regard to FIG. 3.

Fuel injector 32 may be configured to deliver the fuel and fresh air to a combustion chamber 46, defined by a cylindrical combustion chamber member 48. Combustion chamber member 48 may include an upstream end 50 and a downstream end 52 and may be in substantial alignment with longitudinal axis 34 of fuel injector 32. Combustion chamber member 48 may be configured to house a flame within combustion chamber 46 that may be fueled by fuel injector 32. Burner assembly 26 may be configured to burn such a flame on a constant or intermittent basis. Further, burner assembly 26 may be configured to vary the intensity, strength, duration, and/or size of the flame. In one embodiment, burner assembly 26 may be configured to burn a flame intermittently based on an amount of particulates accumulated by particulate trap 18. For example, burner assembly 26 may be configured to burn a flame based on one or more indicators that particulate trap 18 has or may have accumulated a predetermined amount of particulates. Such indicators may include time of engine operation (e.g., since the last regeneration of particulate trap 18) or other engine operating parameters, an increase in back pressure upstream from particulate trap 18, a pressure differential across particulate trap 18, etc.

Burner assembly 26 may also include an ignition device, such as a spark plug 54. Spark plug 54 may be configured to create a spark within combustion chamber 46 to thereby ignite the mixture of fuel and fresh air. Spark plug 54 may be fired periodically to ignite the fuel being delivered by fuel injector 32. For example, spark plug 54 may be fired when fuel delivery is initiated in order to ignite the flame. Further, spark plug 54 may be fired continually to help further stabilize the flame (e.g., keep it burning consistently and with consistent intensity). For example, spark plug 54 may be fired continually whenever fuel is being delivered by fuel injector 32.

Burner assembly 26 may include an exhaust flow distribution member 56, which may be positioned about combustion chamber member 48. For example, exhaust flow distribution member 56 may be positioned concentrically about combustion chamber member 48. Exhaust flow distribution member 56 may be configured to substantially evenly distribute exhaust gases about combustion chamber member 48 in a heat exchange relation to combustion chamber member 48. Exhaust flow distribution member 56 may include holes 58 to facilitate this substantially even distribution of exhaust gases about combustion chamber member 48. In addition, exhaust flow distribution member 56 may be configured to cause the exhaust gases to impinge on the outer surface of combustion chamber member 48, thus, providing cooling of combustion chamber member 48. This cooling may result from the temperature of the exhaust gases being relatively lower than that of combustion chamber member 48, which may be heated by the flame within combustion chamber 46. Thus, the heat exchange relation means that the exhaust gases may draw heat away from (i.e., cool) combustion chamber member 48.

Exhaust outlet 30 may include a conical portion 60. Conical portion 60 may have holes 62 in it, a narrow upstream end 64 attached to downstream end 52 of combustion chamber member 48, and a wide downstream end 66, wider than upstream end 64, and through which all exhaust flow directed through burner assembly 26 may pass. Exhaust outlet 30 may further include a baffle 68 located within conical portion 60 of exhaust outlet 30 and which may be configured to stabilize the flame that is fueled by fuel injector 32. That is, baffle 68 may stabilize the flame by creating a partial barrier to restrain the flame from propagating too far downstream, which could cause damage to particulate trap 18. Baffle 68 may include an unperforated central portion 70 for restraining the central portion of the flame. Baffle 68 may also include holes 72 about its periphery for allowing limited flame propagation beyond baffle 68. The peripheral location of holes 72 and the resulting peripheral flame propagation may contribute to a discharge of the exhaust gases from exhaust outlet 30 having a substantially uniform temperature and velocity.

Figure 3:
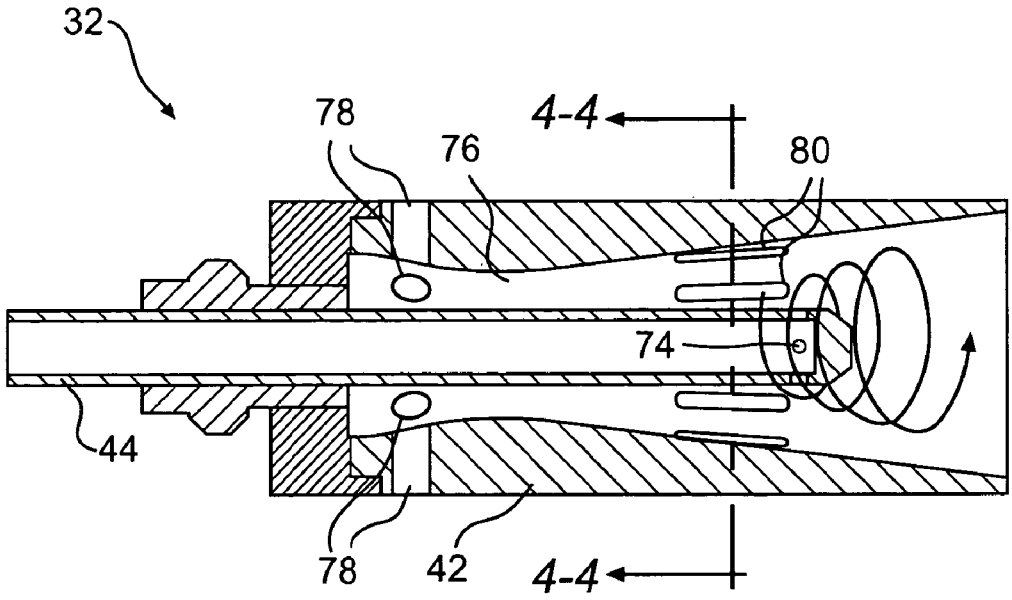
FIG. 3 is a diagrammatic, cross-sectional illustration of a fuel injector according to an exemplary disclosed embodiment.

FIG. 3 illustrates a cross sectional view of fuel injector 32. Fuel conduit 44 may include one or more holes 74 through which fuel may be delivered to an annular cavity 76 defined between fuel conduit 44 and outer annular wall 42. Outer annular wall 42 may be concentric with fuel conduit 44. Holes 74 may be configured to atomize the fuel in preparation for combustion. Fresh air may be drawn into annular cavity 76 through openings in outer annular wall 42, such as holes 78 and/or longitudinal slots 80. Thus, burner assembly 26 may be configured to introduce fresh air to fuel injector 32 upstream of the exhaust flow and downstream of a location at which fuel leaves fuel conduit 44.

Figure 4:
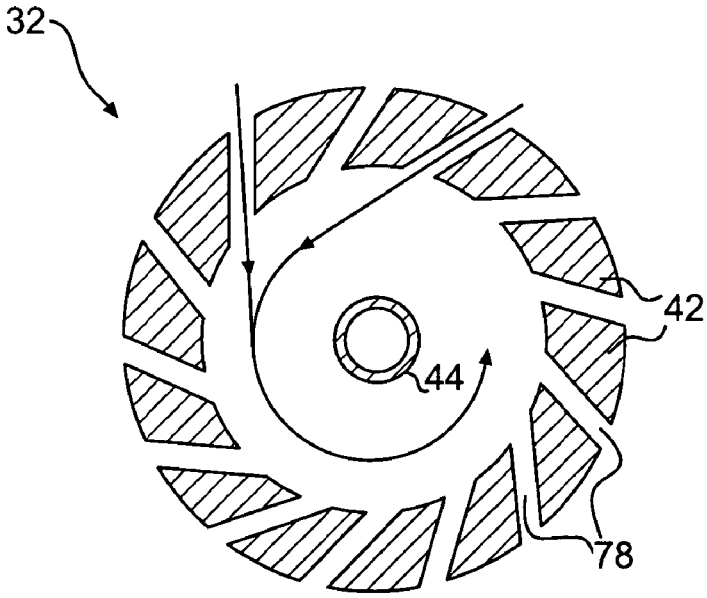
FIG. 4 is a diagrammatic, cross-sectional illustration of the fuel injector of FIG. 3 taken at a section line 4-4 in FIG. 3.

FIG. 4 is a cross-sectional illustration of fuel injector 32 taken at section line 4-4 in FIG. 3. As shown in FIG. 4, longitudinal slots 80 may be angled so as to impart a rotational ("swirling") motion on the fresh air within the annular cavity. Such rotational motion of the fresh air may also create swirling motion of the atomized fuel being dispensed into annular cavity 76 from fuel conduit 44. The swirling motion of the air/fuel mixture may contribute to a uniform distribution of fuel, as well as uniformity in the size of fuel droplets.

INDUSTRIAL APPLICABILITY

The disclosed burner assembly 26 may be suitable to enhance exhaust emissions control for engines. Burner assembly 26 may be used for any application of an engine. Such applications may include, for example, stationary equipment such as power generation sets, or mobile equipment, such as vehicles. The disclosed system may be used for any kind of vehicle, such as, for example, automobiles, work machines (including those for on-road, as well as off-road use), and other heavy equipment.

Burner assembly 26 may be configured to raise the temperature of exhaust gases flowing through it without undesirably restricting the flow of such gases. With minimal flow restriction, burner assembly 26 may avoid creating backpressure within exhaust conduit 20 that could inhibit engine performance. Further, burner assembly 26 may be configured to generate an output flow of exhaust gases at exhaust outlet 30 with a substantially uniform temperature and velocity.

Burner assembly 26 may be configured to raise the temperature of exhaust gases flowing through it by exposing them to a fueled flame. The exhaust gases may be mixed with the flame in stages, as the exhaust gases and flame proceed downstream to prevent the rapidly flowing exhaust gases from extinguishing the flame. The flame may burn within combustion chamber 46 defined by combustion chamber member 48 and may propagate downstream into conical portion 60 of exhaust outlet 30. A small portion of the exhaust gases may be allowed to enter combustion chamber 46 to supply additional oxygen to the flame to burn off any remaining fuel not burned off using the fresh air supplied. This additional oxygen may enable the flame to propagate further downstream.

More of the exhaust gases may be allowed to enter conical portion 60 upstream of baffle 68 and may also supply additional oxygen to the flame, while being heated by it. The flame within conical portion 60 upstream of baffle 68 may propagate through holes 72 of baffle 68 creating a wake on the downstream side of unperforated central portion 70. Gases within this wake may have a low flow rate, which may provide for a flame that does little propagating downstream from that point. The remainder of the exhaust gases may be allowed to enter conical portion 60 downstream of baffle 68. This remainder of gases may include most of the exhaust gases directed through exhaust inlet 28. This remainder of gases may be heated by the flame within conical portion 60 downstream of baffle 68. Hole patterns in conical portion 60 may contribute to the exhaust gases exiting from exhaust outlet 30 with a substantially uniform temperature and velocity.

By introducing fresh air to fuel injector 32 and swirling the fresh air, a stronger, more consistent, more stable, and more evenly distributed flame may be generated than if the exhaust gases were provided as the only source of oxygen to the flame and/or if no swirling were generated. Additionally, because exhaust inlet 28 may be oriented in a direction perpendicular to combustion chamber member 48, exhaust inlet 28 may direct the exhaust gases toward combustion chamber member 48 to provide significant cooling of combustion chamber member 48. Holes 58 in combustion chamber member 48 may facilitate even distribution of the exhaust gases about combustion chamber member 48, which may promote cooling efficiency.

It will be apparent to those having ordinary skill in the art that various modifications and variations can be made to the disclosed burner assembly for particulate trap regeneration without departing from the scope of the invention. Other embodiments of the invention will be apparent to those having ordinary skill in the art from consideration of the specification and practice of the invention disclosed herein. It is intended that the specification and examples be considered as exemplary only, with a true scope of the invention being indicated by the following claims and their equivalents.

What is claimed is:

1. A method of regenerating an exhaust particulate trap, comprising:

directing an exhaust flow, produced by an engine, into a burner assembly, the exhaust flow including at least a portion of a totality of exhaust gases produced by an engine, the burner assembly being located upstream from a particulate trap configured to remove one or more types of particulate matter from the exhaust flow;

directing the exhaust flow through a plurality of holes in an exhaust flow distribution member and thereby substantially evenly distributing the exhaust flow about a combustion chamber member to remove heat from the combustion chamber member, the heat being created by a flame within the combustion chamber member;

heating the exhaust flow in stages as the exhaust flow passes through the burner assembly by exposing a portion of the exhaust flow to the flame at a first stage and exposing additional portions of the exhaust flow to the flame at each subsequent stage to create a heated exhaust flow;

directing the heated exhaust flow out of the burner assembly and to the particulate trap to thereby increase a temperature of the particulate trap.

2. The method of claim 1, further including introducing fresh air to a fuel injector having a fuel conduit and configured to deliver fuel to the combustion chamber, the fresh air being introduced to the fuel injector upstream of the exhaust flow and downstream of a location at which the fuel leaves the fuel conduit.

3. The method of claim 2, further including directing fresh air through longitudinal, angled slots in an outer annular wall of the fuel injector, situated about the fuel conduit thereby imparting a rotational motion on the fresh air.

4. The method of claim 1, wherein the directing of the exhaust flow into the burner assembly includes directing the exhaust flow in a first direction, which is substantially perpendicular to a second direction in which the heated exhaust flow is directed out of the burner.

5. The method of claim 1, wherein the exposing of portions of the exhaust flow to the flame in the first stage includes directing the portions of the exhaust flow through holes in the combustion chamber member and, in the subsequent stages, includes directing the additional portions of the exhaust flow through holes in a conical portion at locations progressively further downstream, the conical portion having an upstream end attached to a downstream end of the combustion chamber member and a downstream end, wider than the upstream end of the conical portion, the totality of exhaust flow directed through the burner assembly passing through the conical portion.

6. The method of claim 5, further including directing at least a portion of the exhaust flow through a baffle located within the conical portion.

7. The method of claim 6, wherein the portion of the exhaust flow that is directed through the baffle is directed through holes about the periphery of the baffle.

8. An exhaust treatment system, comprising:

a particulate trap configured to remove one or more types of particulate matter from an exhaust flow, the exhaust flow including at least a portion of a totality of exhaust gases produced by an engine; and a burner assembly configured to increase a temperature of the exhaust flow at a location upstream from the particulate trap, the burner assembly including:

an exhaust inlet oriented in a direction along a first axis and configured to direct the exhaust flow into the burner assembly;

an exhaust outlet oriented in a direction along a second axis at an angle relative to the first axis, the exhaust outlet being configured to direct the exhaust flow out of the burner assembly toward the particulate trap;

a fuel injector having a longitudinal axis in substantial alignment with the second axis;

a cylindrical combustion chamber member defining a combustion chamber, having a longitudinal axis in substantial alignment with the longitudinal axis of the fuel injector, and configured to house a flame that is fueled by the fuel injector within the combustion chamber; and an exhaust flow distribution member including a first end proximate the fuel injector and at least one inlet hole distant from the first end, the exhaust flow distribution member configured to substantially evenly distribute exhaust about an outer surface of the combustion chamber member and in a heat exchange relation to the combustion chamber member.

9. The system of claim 8, wherein the first axis is substantially perpendicular to the second axis.

10. The system of claim 8, wherein the exhaust flow distribution member is positioned concentrically about the combustion chamber member and overlapping a majority length of the combustion chamber member.

11. The system of claim 8, wherein the fuel injector includes a fuel conduit configured to deliver fuel to the combustion chamber, the burner assembly being configured to introduce fresh air to the fuel injector upstream of the exhaust flow and downstream of a location at which the fuel leaves the fuel conduit.

12. The system of claim 11, wherein the fuel injector further includes an outer annular wall about the fuel conduit and defining an annular cavity, the outer annular wall including longitudinal slots through which the fresh air is introduced to the annular cavity, the slots being angled so as to impart a rotational motion of the fresh air within the annular cavity.

13. The system of claim 8, wherein the combustion chamber member includes an upstream end and a downstream end and the exhaust outlet includes a conical portion having holes in the conical portion, the conical portion having an upstream end attached to the downstream end of the combustion chamber member and a downstream end, wider than the upstream end of the conical portion and through which all exhaust flow directed through the burner assembly passes.

14. The system of claim 13, further including a baffle located within the conical portion of the exhaust outlet and configured to stabilize the flame that is fueled by the fuel injector.

15. The system of claim 14, wherein the baffle includes holes its periphery.

16. A machine having an exhaust treatment system, comprising:

an exhaust gas producing engine;

an exhaust conduit for directing an exhaust flow to a particulate trap configured to remove one or more types of particulate matter from the exhaust flow, the exhaust flow including at least a portion of a totality of exhaust gases produced by the engine; and a burner assembly configured to increase a temperature of the exhaust flow at a location upstream from the particulate trap, the burner assembly including:

an exhaust inlet configured to direct the exhaust flow into the burner assembly;

an exhaust outlet configured to direct the exhaust flow out of the burner assembly toward the particulate trap, the exhaust outlet includes a conical portion and is oriented in a direction substantially perpendicular to the exhaust inlet;

a fuel injector having a longitudinal axis in substantial alignment with the direction in which the exhaust outlet is oriented;

a cylindrical combustion chamber member defining a combustion chamber, having a longitudinal axis in substantial alignment with the longitudinal axis of the fuel injector, and configured to house a flame that is fueled by the fuel injector within the combustion chamber; and an exhaust flow distribution member positioned about the combustion chamber member and configured to substantially evenly distribute the exhaust flow about an outer surface of the combustion chamber member and in a heat exchange relation to the combustion chamber member.

17. The machine of claim 16, wherein the fuel injector includes a fuel conduit configured to deliver fuel to the combustion chamber, the burner assembly being configured to introduce fresh air to the fuel injector upstream of the exhaust flow and downstream of a location at which the fuel leaves the fuel conduit.

18. The machine of claim 17, wherein the fuel injector further includes an outer annular wall, about the fuel conduit, and defining an annular cavity, the annular wall including longitudinal slots through which the fresh air is introduced to the annular cavity, the slots being angled so as to impart a rotational motion on the fresh air within the annular cavity.

19. The machine of claim 16, wherein the combustion chamber member includes an upstream end and a downstream end and the conical portion having holes in the conical portion, the conical portion having an upstream end attached to the downstream end of the combustion chamber member and a downstream end, wider than the upstream end of the conical portion, and through which all exhaust flow directed through the burner assembly passes.

20. The machine of claim 19, further including a baffle located within the conical portion of the exhaust outlet and configured to stabilize the flame that is fueled by the fuel injector.

21. The machine of claim 20, wherein the baffle includes holes about its periphery.

* * * * *